US006050291A

United States Patent [19]

Whitehead et al.

[11] Patent Number: 6,050,291

[45] Date of Patent: Apr. 18, 2000

[54] ENCLOSED HOSE REEL

[75] Inventors: Stephen P. Whitehead, Elgin; Torrence C. Anderson, Aurora; Michael G. Uffner, Naperville, all of Ill.

[73] Assignee: Suncast Corporation, Batavia, Ill.

[21] Appl. No.: 09/290,158

[22] Filed: Apr. 12, 1999

[51] Int. Cl.[7] ..... A62C 35/00

[52] U.S. Cl. ..... 137/355.26; 137/377; 137/355.16

[58] Field of Search ..... 137/377, 355.26, 137/355.16

[56] References Cited

U.S. PATENT DOCUMENTS

| | | | |
|---|---|---|---|
| 5,526,842 | 6/1996 | Christensen | 137/360 |
| 5,560,391 | 10/1996 | Bantaculo | 137/355.23 |
| 5,568,824 | 10/1996 | Cordrey | 137/355.27 |
| 5,678,596 | 10/1997 | Corallo | 137/357 |
| 5,678,599 | 10/1997 | Moss | 137/377 |

OTHER PUBLICATIONS

Southern Patio Catalog (2 pages), Southern Patio Company of Atlanta, Georgia.

Kinsman Company Catalog (1 page).

Emsco Group Catalog (1 page), Emsco Group of Girard, Pennsylvania.

L.L. Home Outdoor Living Catalog (3 pages including pp. 7, 8 & 9), L.L. Bean™ Company of Freeport, Maine.

Gardener's Supply Company (1 page), Gardener's Supply Company of Burlington, Vermont.

*Primary Examiner*—A. Michael Chambers
*Assistant Examiner*—Thomas L. McShane
*Attorney, Agent, or Firm*—Welsh & Katz, Ltd.

[57] ABSTRACT

An enclosed hose reel for use with an associated flexible hose includes a spool carried by and enclosed within an enclosure. The spool has a hub and a pair of flanges at opposing ends of the hub and is configured for storage, take-up and pay-out of the flexible hose. The enclosure has front and rear wall panels, side wall panels extending between the front and rear wall panels, and a cover. The enclosure is configured for receiving the spool so as to rotate within the enclosure and for storing a length of flexible hose on the spool within the enclosure. A pair of hinges mounts the cover to the enclosure for movement between a closed position and an open position and for maintaining the cover in the open position. Each hinge includes a track formed in a respective side wall panel and a pair of pins associated and cooperative with each track. Each track includes a generally straight leg portion contiguous with a return portion that is non-linear with the straight leg portion. When the cover is in the open position, both pins of each pair are positioned in the straight leg portion and when the cover is rotated into the closed position, one of each pair of pins traverses the straight leg portion so as to provide a sliding pivot and the other of each pair of pins traverses from the straight leg portion into the return portion so as enable closing the cover.

32 Claims, 10 Drawing Sheets

ENCLOSED HOSE REEL

FIELD OF THE INVENTION

This invention pertains to hose reels. More particularly, the invention pertain to a hose reel that is mounted within a concealing enclosure.

BACKGROUND OF THE INVENTION

Garden hoses are a necessity for homeowners and the like for lawn and garden care, as well as general all-around home care. Typically, hoses are found either wound and left on the ground near a water spigot, or wound on one of many known hose reel-type storage devices. These devices include portable hose reel carts and stationary hose reel hangers that can be mounted to a surface of a building, such as an outer wall of a house. For off-season storage, hoses are often found on the floor of a garage or other storage area.

A typical portable hose reel cart includes an open, rotatable reel or spool positioned between a pair of side frames. These carts include wheels to permit ready transport of the hose from one location to another. The hose is merely wound upon the reel for storage and pulled or dispensed from the reel for use.

Although such carts have become wide-spread in use because of their neat and orderly storage capabilities, they do have their drawbacks. First, a hose stored on such a reel is open to the environs. Often hoses are made rubber or like materials that can become stiff or brittle and can break when subjected to low temperature extremes, particularly with advanced age. In addition, ultra-violet radiation has been known to accelerate degradation of many of these materials.

Moreover, hose reel carts may be considered by some to be unsightly. As such, some users may be inclined to constantly remove a hose reel cart, particularly from the front of a house.

This can be exaggerated when, for example, the cart becomes dirty, muddy and the like. Given that most hose reel carts are designed for use in and around garden and lawn areas, it is expected and natural for these carts to become dirty.

Surface (or wall) mounted hose reels or hangers also come in a wide variety of configurations. For example, one surface mounted hose reel includes a rotatable reel mounted to a fitting that is mounted to the building surface. Another surface mounted device or hanger includes a simple, semi0curcular metal or plastic support that is mounted to the building, over which the hose is looped or hung. These surface mounted reels and hangers, like the portable carts could be considered unsightly, particularly if they are mounted to the front of the building and are not covered or otherwise obscured by plantings, foliage or the like.

Accordingly, there exists a need for a hose reel storage device that permits ready take-up and dispensing of a hose, that is also aesthetically pleasing. That is, such a hose reel storage device can be used to "hide-away" the hoses stored therein when not in use, and desirably provides a protective, outwardly aesthetically pleasing appearance.

SUMMARY OF THE INVENTION

An enclosed hose reel for use with an associated flexible hose includes a rotatable spool carried and enclosed within an enclosure. The spool has a hub and a pair of flanges at opposing ends of the hub, and is configured for storage, take-up and pay-out of the flexible hose.

The enclosure has front and rear wall panels, side wall panels extending between the front and rear wall panels, and a cover. The enclosure is configured for receiving the spool so as to rotate within the enclosure and for storing a length of flexible hose on the spool within the enclosure.

The cover pivots about a pair of hinges that mount the cover to the enclosure for movement between a closed position and an open position and for maintaining the cover in the open position. Each hinge includes a track formed in a respective side wall panel and a pair of pins associated and cooperative with each track. Each track includes a generally straight leg portion contiguous with a return portion that is non-linear with the straight leg portion. In this configuration, when the cover is in the open position both pins of each pair are positioned in the straight leg portion. When the cover is rotated into the closed position, one of each pair of pins traverses the straight leg portion so as to provide a sliding pivot and the other of each pair of pins traverses from the straight leg portion into the return portion.

In a preferred embodiment, the non-linear portion of each track is arcuate. Most preferably, the track has an upside-down "J" shape, and has a substantially constant cross-sectional width.

The cover can be formed having a depending lip, and the pins can extend from the lip. Preferably, the pins are formed as cylindrical elements extending from the lip, parallel to one another.

To facilitate take-up and pay-out the hose with the cover closed, the front wall panel can include a cut-out portion at about a top edge thereof adjacent a junction with the cover. In this arrangement, when the cover is closed, the cut-out accommodates traversing a portion of the flexible hose therethrough.

In one embodiment, the spool extends essentially entirely between the side wall panels. Using, the great extent, the internal space of the enclosure. Alternately, the enclosure includes a partition wall extending between the front and rear wall panels parallel to the side wall panels. The partition wall permits use of the enclosure with a small capacity spool that extends between one of the side wall panels and the partition wall. In this arrangement, a support member can be formed to extend between the partition wall and the side wall panel in opposing relation to the spool. The support member can a storage region, such as a shelf and the like for storing hose implements such as spray heads and watering heads.

Other features and advantages of the present invention will be apparent from the following detailed description, the accompanying drawings, and the appended claims.

DETAILED DESCRIPTION OF THE PREFERRED EMBODIMENTS

Figure 1:
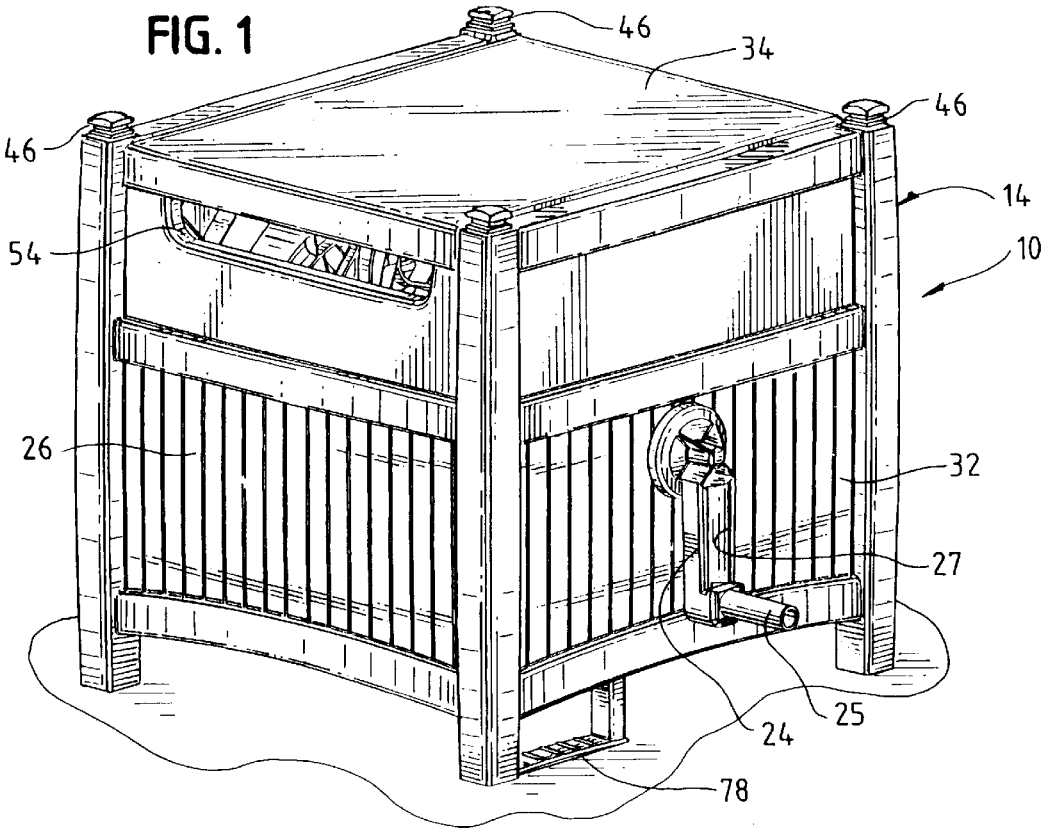
FIG. 1 is a perspective view of an embodiment of the enclosed hose reel storage device showing the hose reel handle or winding crank that is used for winding the hose onto the hose reel or spool.
Figure 2:
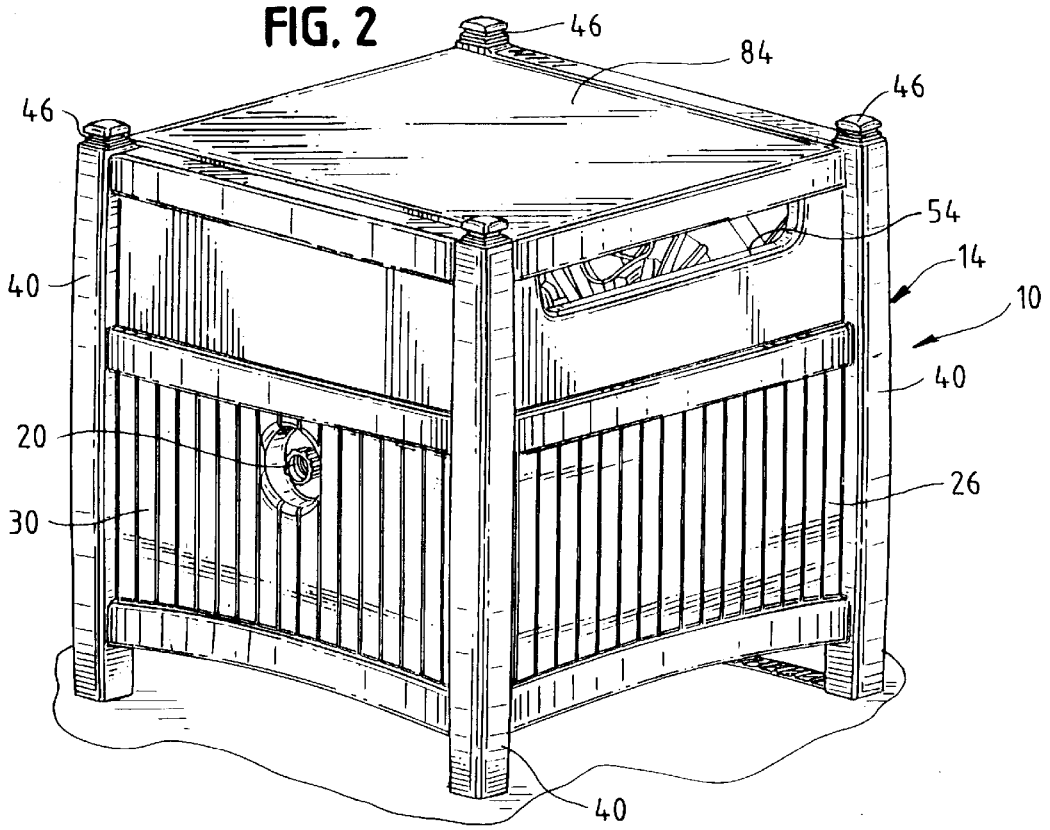
FIG. 2 is a perspective view of the hose reel storage device of FIG. 1 as viewed rotated 90° counterclockwise from the view illustrated in FIG. 1.
Figure 3:
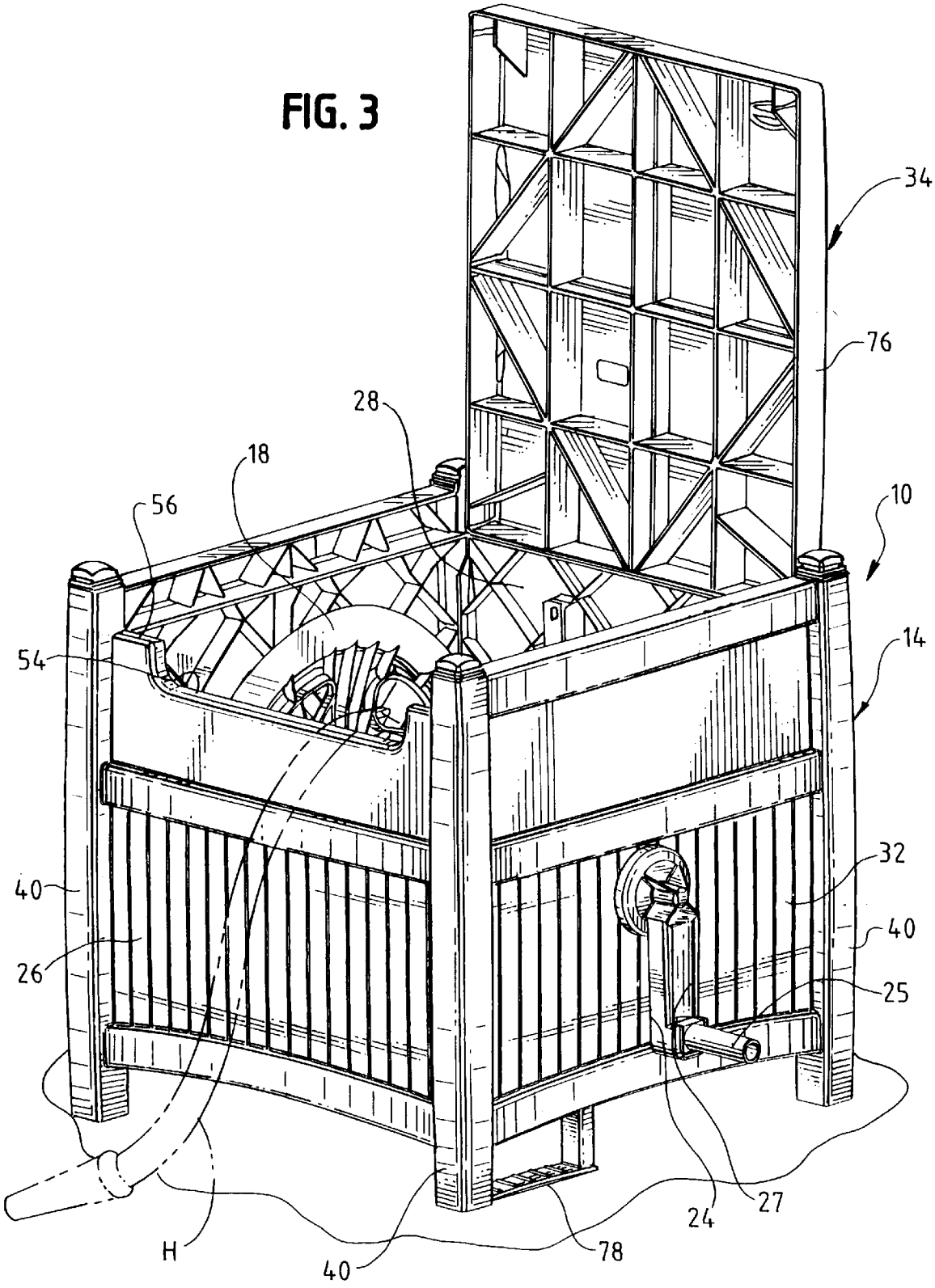
FIG. 3 is a perspective view of the hose reel storage device similar to FIG. 1, with the cover pivoted upwardly for access to the hose reel spool and hose stored thereon, and illustrated with a portion of a hose extended outwardly from the device, shown in phantom lines.
Figure 4:
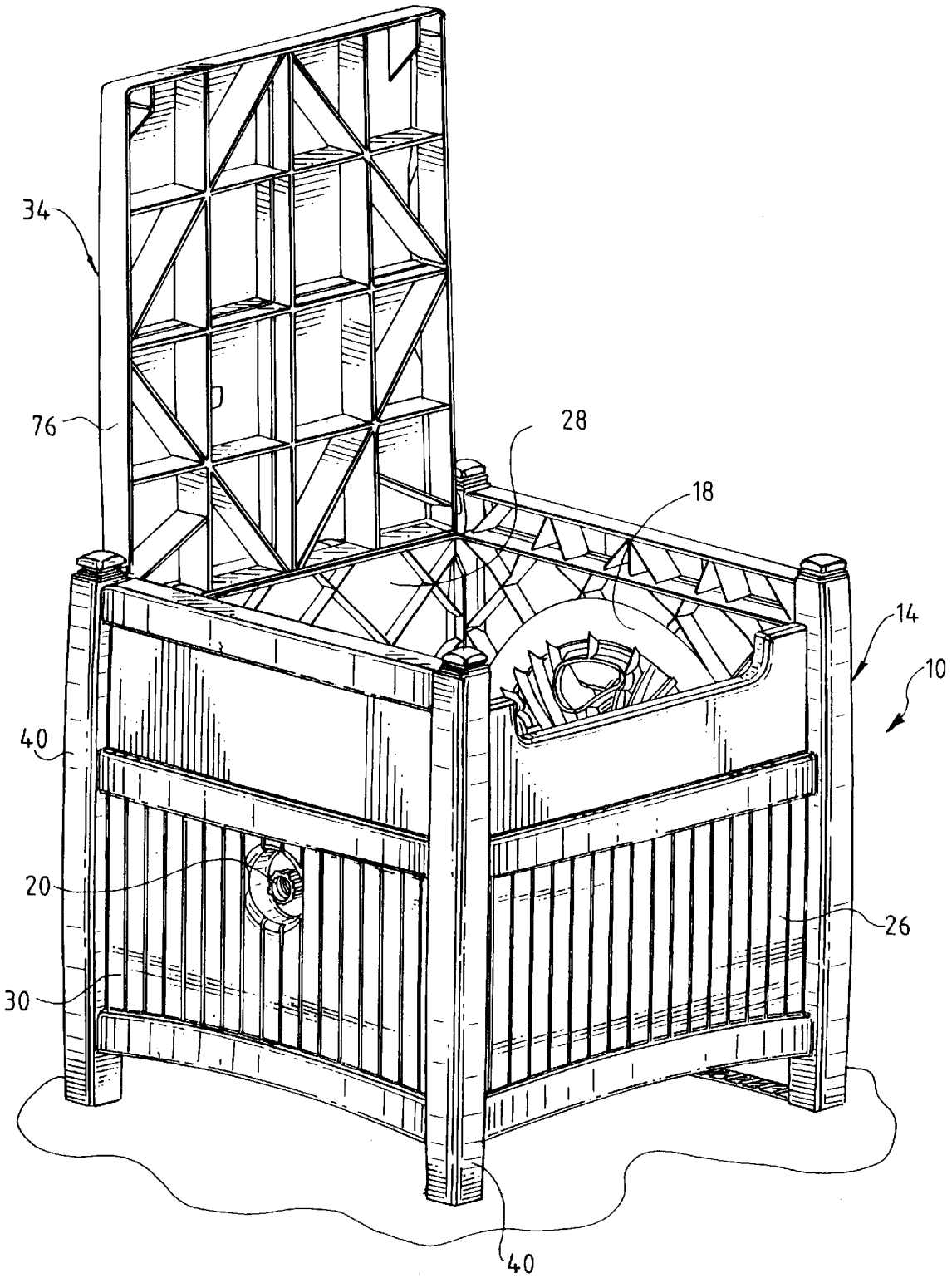
FIG. 4 is a perspective view of the hose reel storage device taken from the same perspective as that of FIG. 2, illustrated with the cover in the open position.
Figure 5:
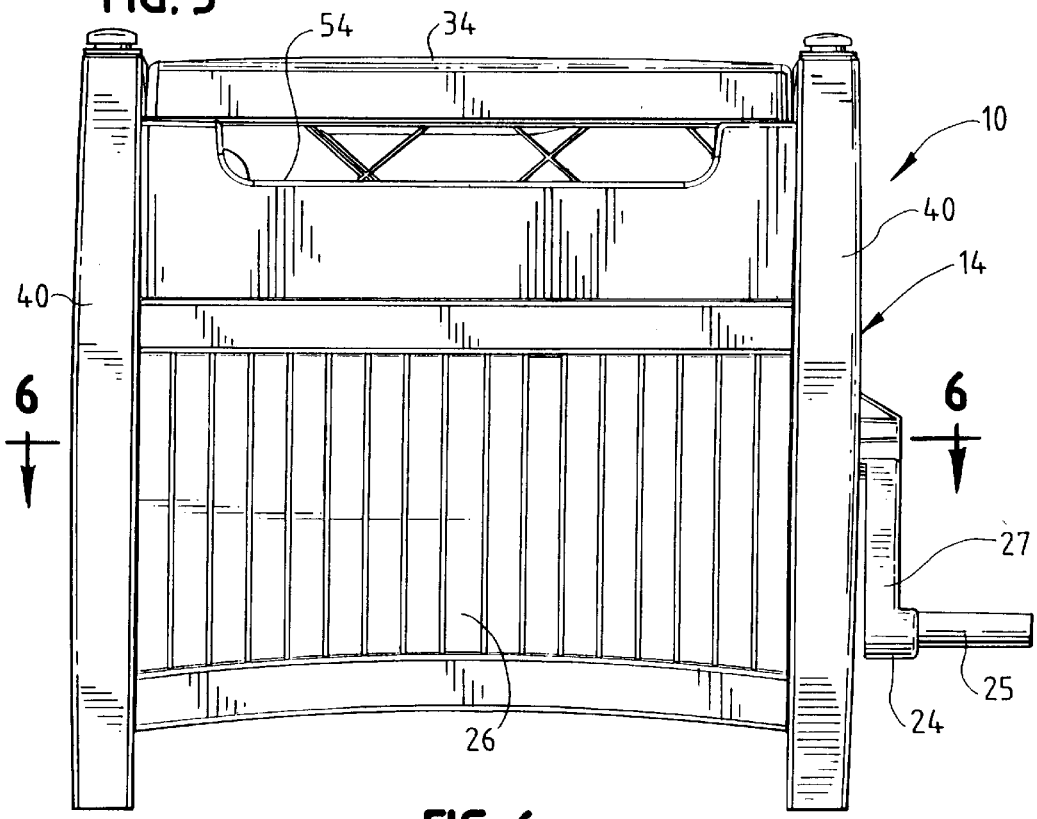
FIG. 5 is a front view of the hose reel storage device with the cover closed.

While the present invention is susceptible in various forms, there is shown in the drawings and will hereinafter be described presently preferred embodiments with the understanding that the present disclosure is considered an exemplification of the invention and is not intended to limit the invention to the specific embodiments illustrated.

Referring now to the figures, generally, there is shown an enclosed hose reel 10 in accordance with the principles of the present invention. The enclosed hose reel 10 includes a reel or spool 12 onto which the hose H is wound or taken up, and from which the hose H is fed out or paid out. The spool 12 is positioned in an enclosure 14. The spool 12 includes a central hub 16 and a pair of radially extending flanges 18 that are configured to accommodate a length of the flexible hose H wrapped around the hub 16 between the flanges 18. In a typical arrangement, the hose reel 10 can store about 200–250 ft. of common ⅝ inch garden hose H.

Those skilled in the art will recognize that the hose reel 10 includes a water inlet port or in-tube 20 and an outlet port or out-tube 22. The in-tube 20 is mounted to the enclosure 14 at about the axis of rotation A of the spool 12. The in-tube 20 is connected to the out-tube 22 by a sliding seal arrangement (not shown) which arrangement will be recognized by those skilled in the art. This arrangement permits the in-tube 20 to remain fixed to the enclosure 14, while the out-tube 22 rotates with the spool 12. In this configuration, the in-tube 20 and out-tube 22 remain in fluid communication with one another. This arrangement permits rotating the spool 12 without twisting or torquing internal components, while maintaining sealed fluid communication between the water supply and the hose H. A winding handle or crank 24 is external of the enclosure 14 and is connected to the spool 12, on an end opposite to that of the in-tube 20, to facilitate take-up of the hose H. The handle 24 can include a folding hand-grip portion 25 that folds into a recess 27 formed in the handle 24.

The spool 12 is fully contained within and carried by the enclosure 14. The enclosure 14 includes front and rear walls 26, 28, respectively, side walls 30, 32, and a pivoting top or cover 34. Optionally, the enclosure 14 can include a bottom panel (not shown) for substantially fully enclosing the spool 12 and protecting the spool 12 and hose H from the environs. As will be apparent from the drawings, the front, rear and side panels 26–32, and the cover 34 enclose the spool 12 such that the spool is not visible from outside of the enclosure 14 when the cover 34 is closed.

Figure 11:
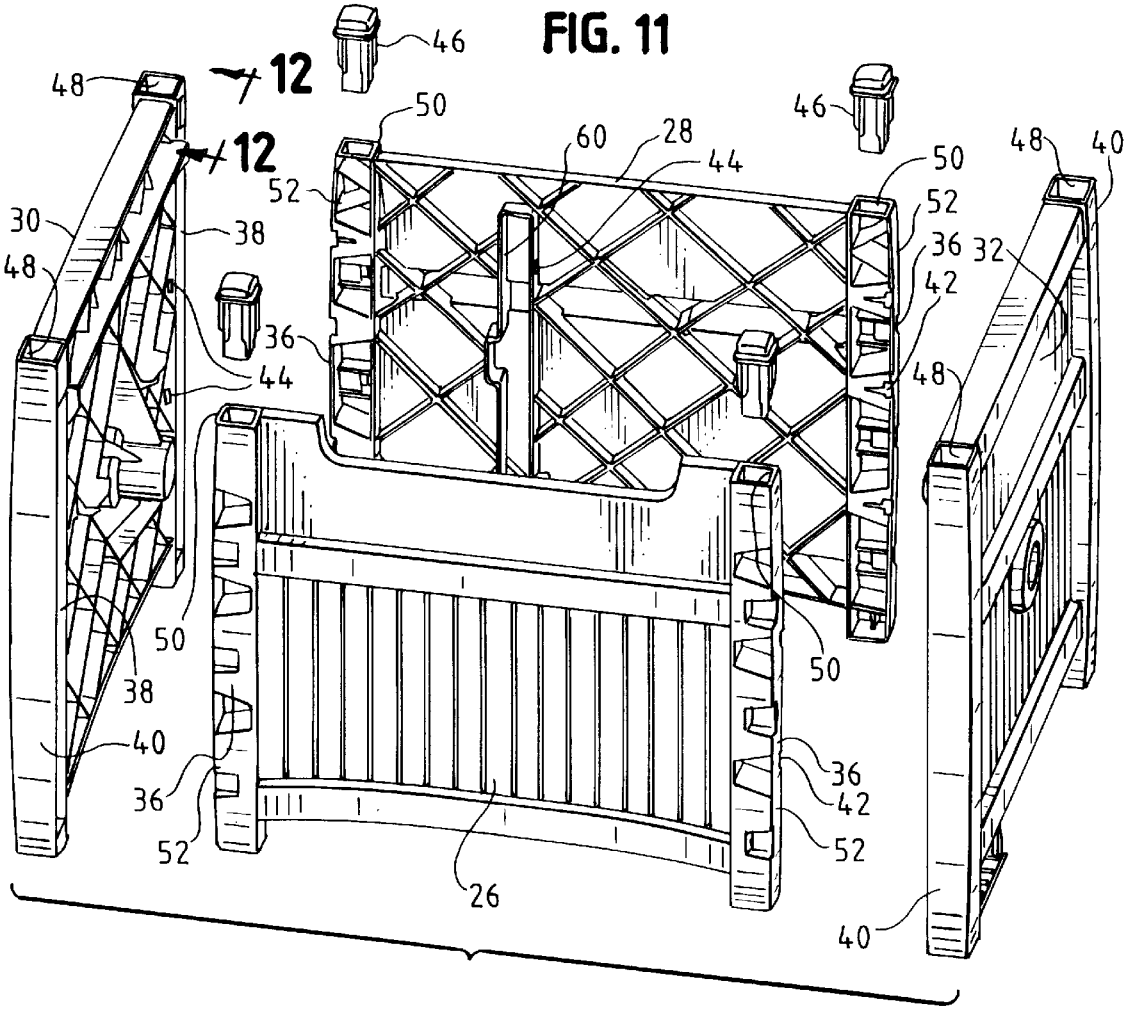
FIG. 11 is a partially exploded view of the hose reel storage device, again illustrated with the internal components removed, and showing the panels in a pre-assembled configuration.

The panels 26–34 are preferably molded components formed from high strength polymeric (plastic) material, such as polystyrene and the like. The panels 26–34 are most preferably configured such that the front and rear panels 26, 28 have fittings 36 that insert into recesses or channels 38 formed in support posts 40 that extend along each side of the side wall panels 30, 32, as shown in FIG. 11. The fittings 36 include ramped surfaces or snap-type elements 42 that engage openings 44 in the channels 38 to lock the panels to one another.

The front and rear panels 26, 28 are further secured to their respective side panels 30,32 by end caps or finials 46 that insert through top openings 48 in the support posts 40 and through top openings 50 in the front and rear panel side portions 52 to secure the front and rear panels 26, 28 to the side panels 30, 32 at their respective support posts 40. In this manner the front and rear panels 26, 28 are positively secured to the side panels 30, 32 not only by the fittings 36 and channels 38, but also by the finials 46 extending into the end posts 40 which provides transverse securing of the structure.

Advantageously, this configuration permits ready assembly of the enclosure 14 with a minimum number of tools, and involves a minimum number of parts. Individuals who have had occasion to assemble many "some assembly required" household and outdoor type items will recognize the extreme advantage that the present "snap-together" type of construction provides.

The front panel 26 can include a cut-out portion 54 extending downwardly from a top lip 56 thereof. The cut-out portion 54 can be elongated and is sized to accommodate a diameter of standard size garden hose H so that the hose can be paid-out from or taken-up onto the spool 12 without lifting the cover 34. That is, the hose H can freely move through the cut-out opening 54 without opening the cover 34.

Figure 6:
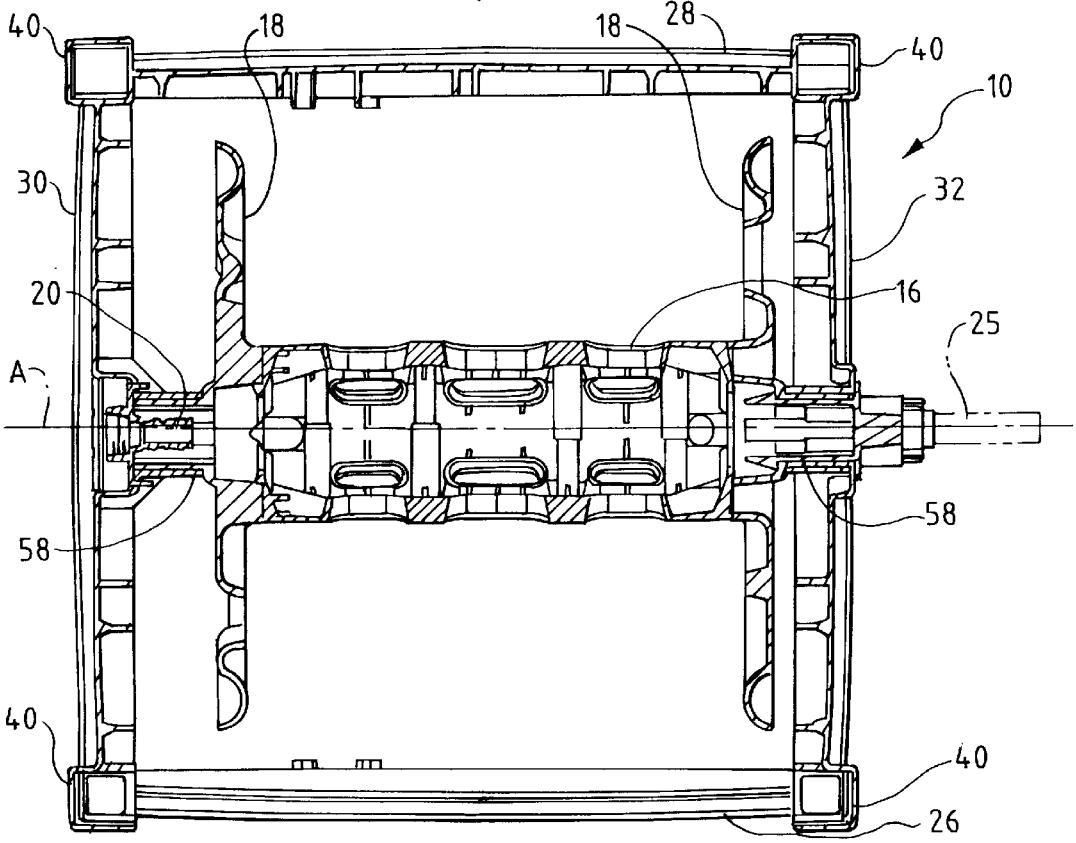
FIG. 6 is a cross-sectional view of the hose reel storage device taken substantially along line 6—6 of FIG. 5.
Figure 7:
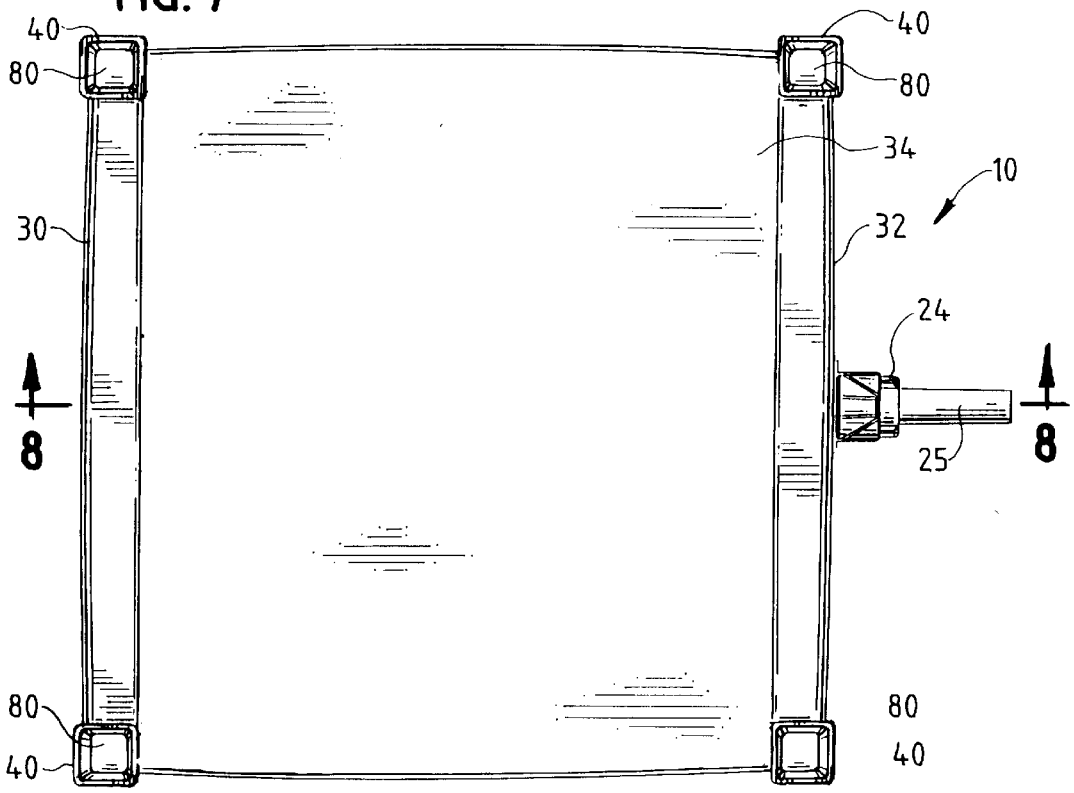
FIG. 7 is a top view of the hose reel storage device.
Figure 8:
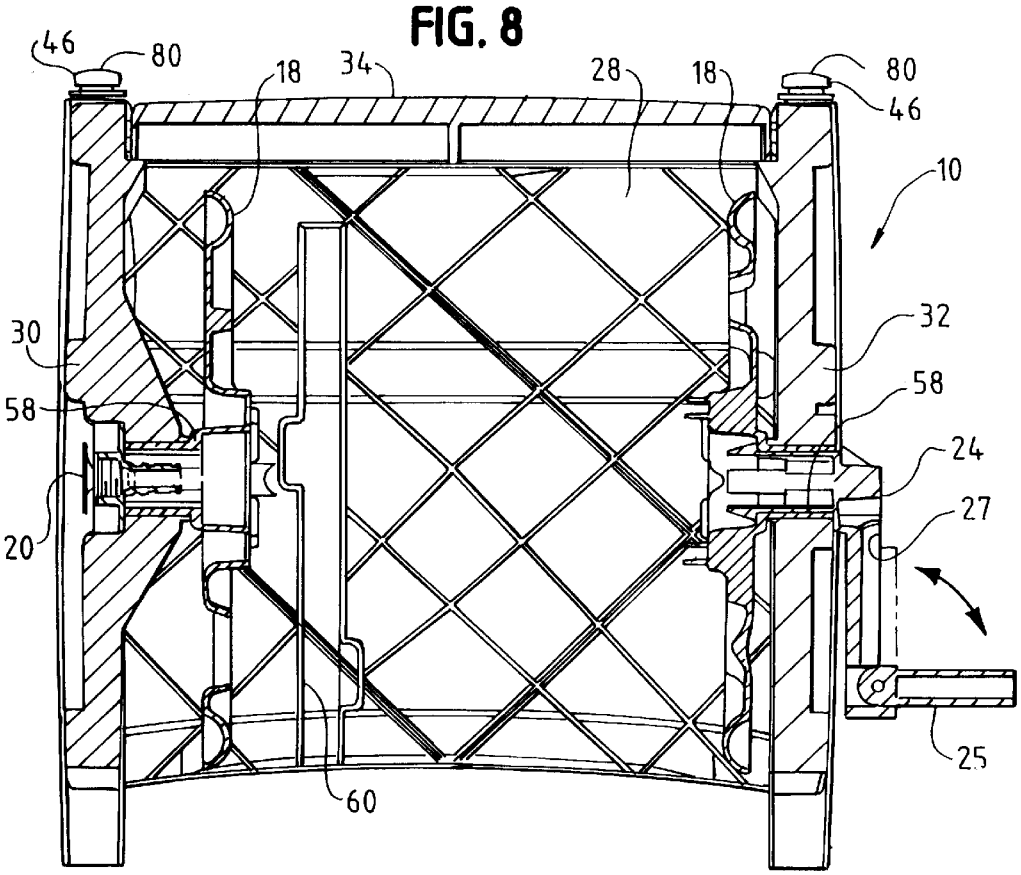
FIG. 8 is a cross-sectional view of the hose reel storage device taken along line 8—8 of FIG. 7, the storage device being shown with the central hub of the spool removed for clarity of illustration.

In the embodiment illustrated in FIGS. 6 and 8, the spool 12 extends essentially entirely between the side panels 30, 32, utilizing, to a maximum extent, the space within the enclosure 14, except for those spaces needed for the spool bearing portions 58 and the in-tube assembly 20.

Alternately, the enclosure 14 can be configured to accommodate a smaller spool 112 for those situations in which a lesser amount of hose H need be stored on the spool 112. Such an arrangement is illustrated in FIGS. 14 through 17, in which the enclosure 14 includes a partition wall 116 that extends between the front and rear walls 26, 28, parallel to the side walls 30, 32. The partition wall 116 is configured with an opening 118 therein for accommodating the bearing portion 58 of the spool 112. The partition wall 116 thus supports the smaller spool 112 within the enclosure 14. In this manner, the aesthetic appeal of the enclosure 14, including its relative size and proportions can be maintained, and all of the components thereof can be used for accommodating both the full-sized and small spools 12, 112.

Figure 10:
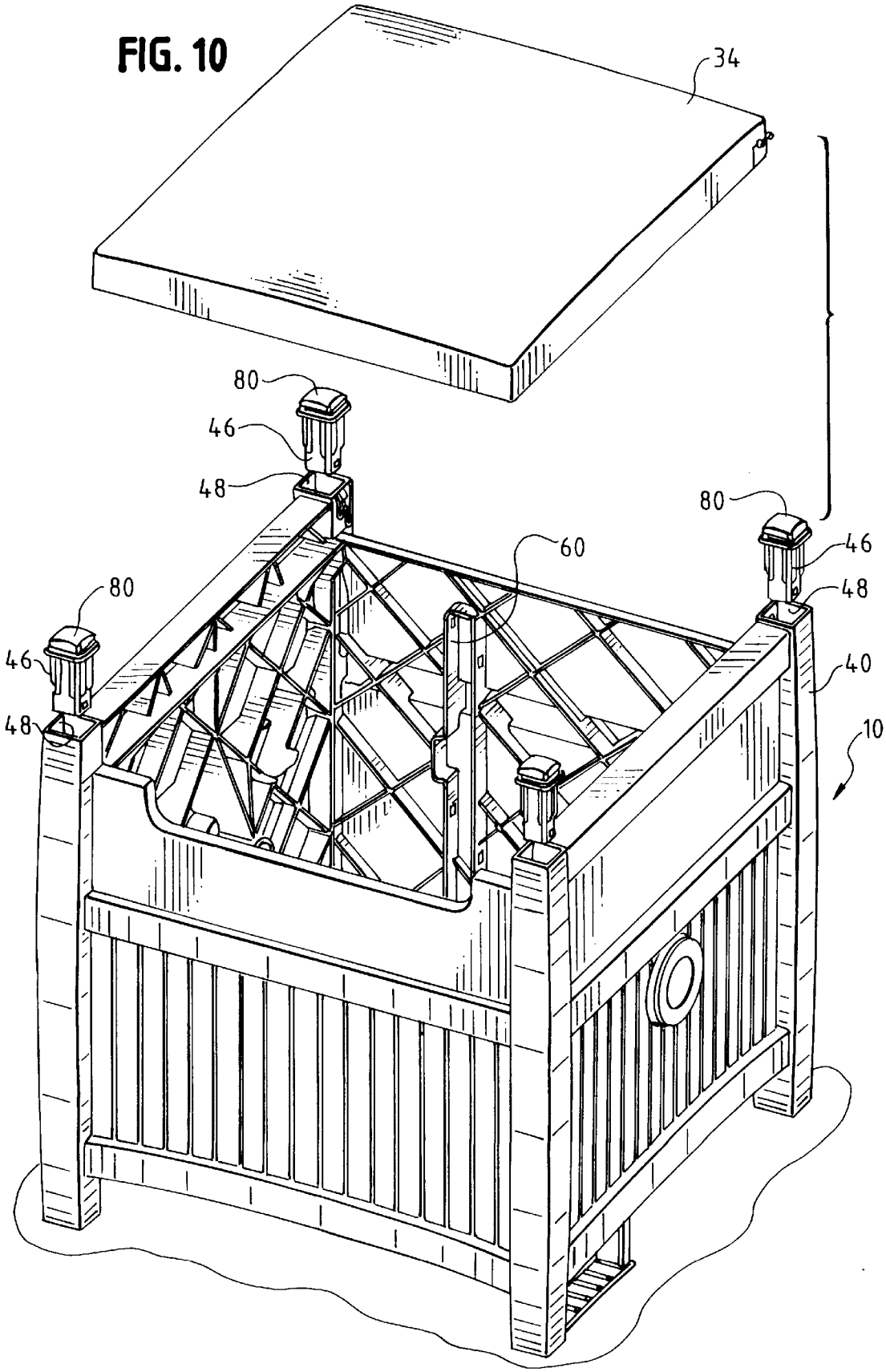
FIG. 10 is a partially exploded view of the hose reel device as shown with the internal components removed, and illustrating the support post top caps and cover.

The partition wall 116 inserts into channels or recesses 60 formed in the front and rear walls 26, 28, as shown in FIGS. 10 and 11, in a manner similar to that in which the front, rear 26, 28 and side panels 30, 32 are assembled to one another. A support, such as the exemplary shelf-like member 120, can be positioned between the partition wall 116 and the side wall 30, opposingly oriented relative to the spool 112, for storing garden and hose implements and the like. The shelf 120 also provides additional support for the partition wall 116 to assure structural and functional integrity of the enclosure 14.

The cover or top panel 34 is fitted to the panels 26–32 using a unique hinge arrangement indicated generally at 62, best seen in FIGS. 10 through 13. The hinge arrangement 62 permits pivoting or rotating the cover 34 between the closed position shown in FIG. 12 and the open position shown in FIG. 13. The novel hinge arrangement 62 is configured so that the cover 34, when opened, is maintained in the open position, without the use of an additional or secondary cover lock or support.

The hinge arrangement 62 includes a channel or track 64 formed in each of the side panels 30, 32 at about the upper rear corners as indicated at 66. The tracks 64 are formed having a first, generally straight leg portion 68 and a return portion 70 that is contiguous and non-linear with the straight leg portion 68. In the illustrated embodiment, the tracks 64 have an upside-down J-shaped configuration and are formed having the extended leg of the "J" (the straight leg portion 68) at the rear-most portion of the panels 30, 32, and the hook portion of the "J" (the return portion 70) oriented toward the front of the panels 30, 32.

Figure 12:
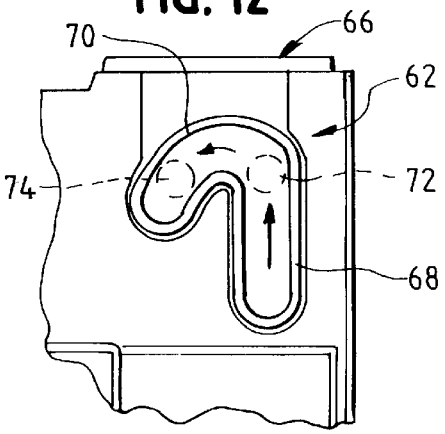
FIG. 12 is a partial view taken along line 12—12 of FIG. 11, illustrating the top cover hinge arrangement of the storage device, and showing the cover hinge pin moving into a position to permit closure of the cover.

A pair of outwardly extending pins, namely a pivot pin 72 and a stay pin 74, extend from each side of the cover 34. In a present embodiment, the cover 34 has a depending lip 76, from which the pins 72, 74 extend. Each pair of pins 72, 74 is configured to engage a respective one of the hinge tracks 64. The pins 72, 74 are configured to cooperate with their respective tracks 64 to permit pivoting or rotating the cover 34, with the stay pin 74 traversing through both the leg portion 68 of the "J" (upwardly and downwardly) and through the hook portion 70 of the "J" (rotationally or arcuately), while the pivot pin 72 remains, and moves up and down in the leg portion 68 of the "J". As illustrated in FIG. 12, the pivot and stay pins 72, 74 are horizontally oriented relative to one another when the cover is closed. In the closed position, the stay pin 74 is positioned in the hook portion 70 of the "J" and the pivot pin 72 is positioned in the leg portion 68 of the "J".

Figure 13:
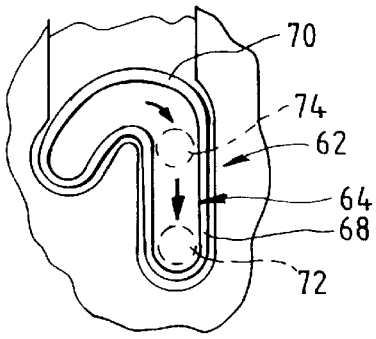
FIG. 13 is a view of the hinge pin similar to FIG. 12, illustrating the cover hinge pin being moved into a position to permit opening of the cover and illustrating the position of the hinge pin so as to maintain the cover in the open position.
Figure 14:
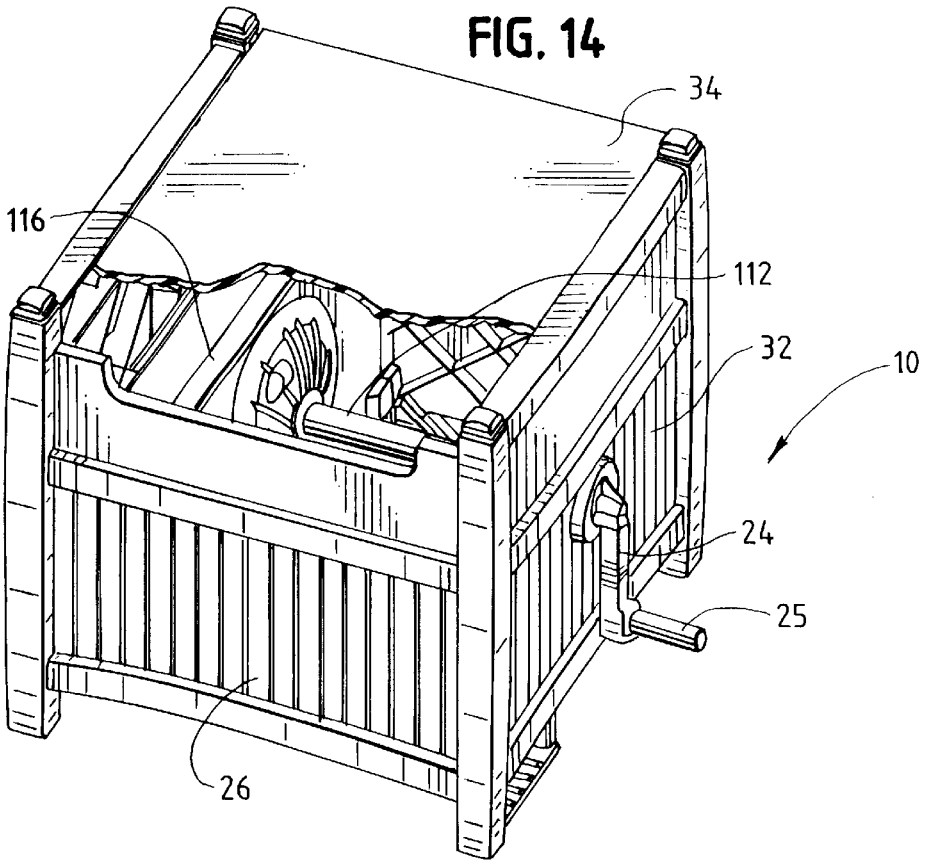
FIG. 14 is a top, front perspective view of the hose reel storage device with a portion of the top cover removed, illustrating the spool within the enclosure, the device of FIG. 14 being illustrated with a partial partition wall for accommodating a smaller spool.
Figure 15:
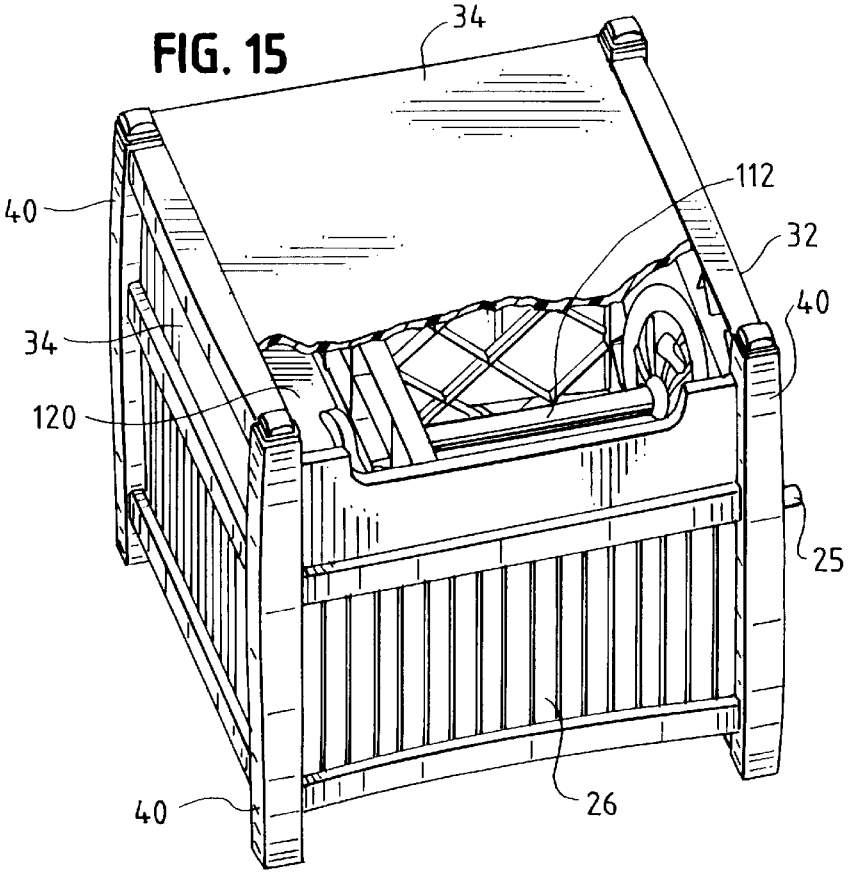
FIG. 15 is a perspective view of the hose reel cart of FIG. 14, as illustrated from a perspective rotated about 90° counter clockwise from that of FIG. 14.
Figure 16:
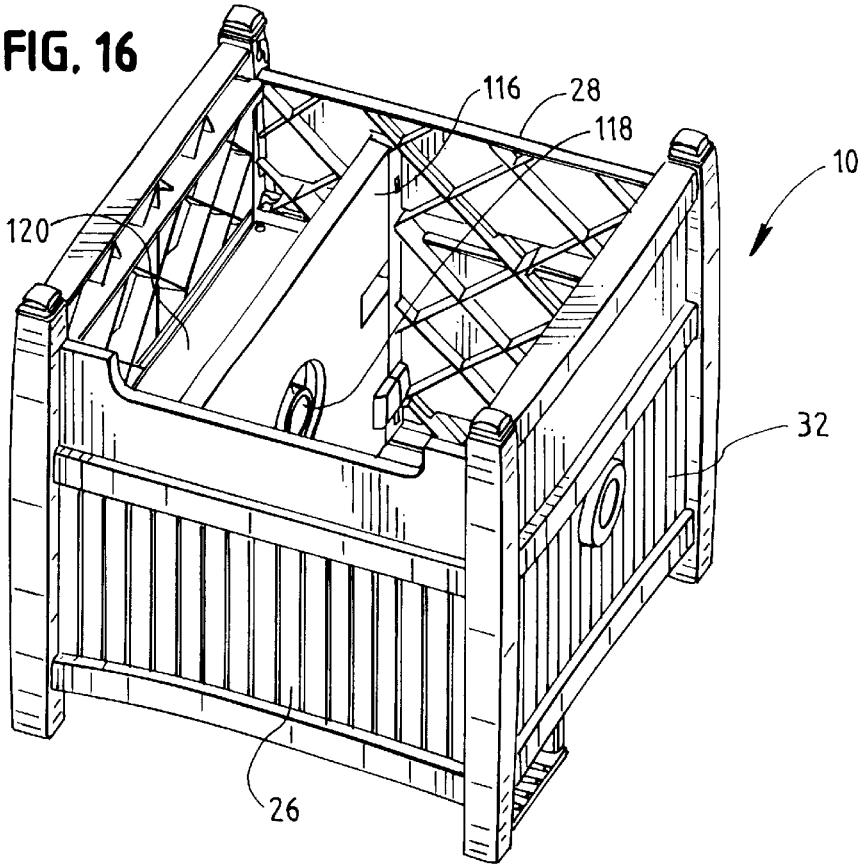
FIG. 16 is a top, perspective view of the hose reel device of FIG. 14, shown with the cover removed and with the spool removed to illustrate the positioning and configuration of the partition wall.
Figure 17:
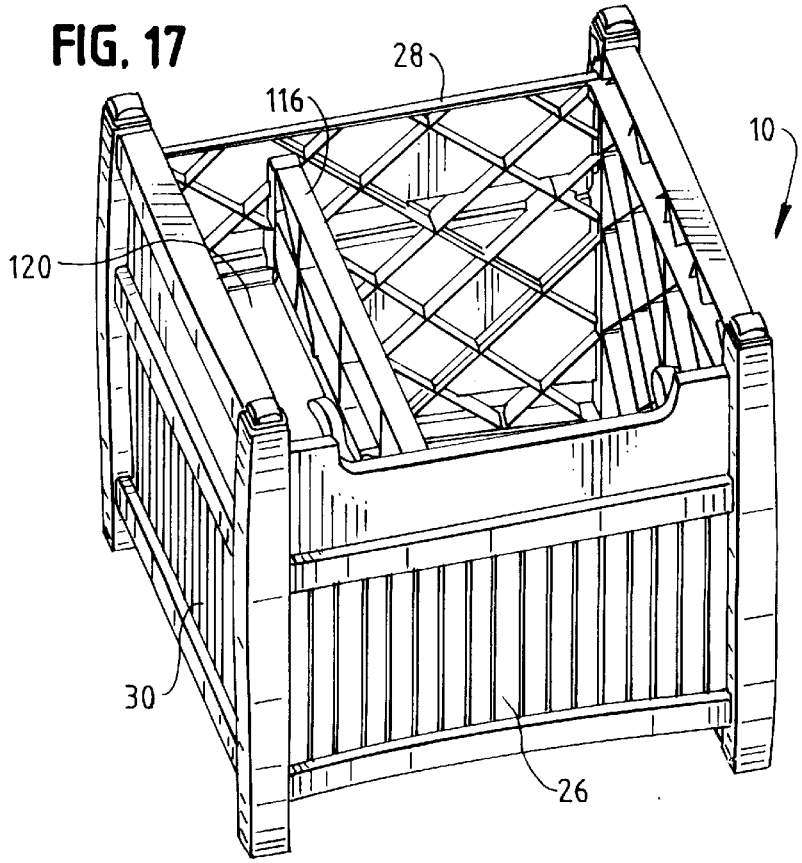
FIG. 17 is a top, perspective view similar to FIG. 15, with the top cover and the hose reel removed to further illustrate the configuration and position of the partition wall.

To open the cover 34, it is necessary only to pivot the cover 34 upward which urges the stay pin 74 through the hook portion 70 and into the straight leg portion 68. As the stay pin 74 rotates upwardly (through the hook 70 and into the leg 68 as illustrated in FIG. 13), the pivot pin 72 moves downwardly further into the leg portion 68 of the track 64. This downward movement of the pivot pin 72 provides sufficient space within the leg portion 68 of the "J" to accommodate the stay pin 74. With both pins 72, 74 in the leg portion 68 of the "J", as illustrated in FIG. 13, the cover 34 is maintained opened. As will be readily apparent from this description, as well as from an understanding of FIGS. 10 through 13, this rather unique hinge arrangement 62 permits readily opening the cover 34 of the enclosure 14 and maintaining the cover 34 open. To close the cover 34, it is necessary only to urge the cover 34 slightly upward (i.e., collinear upward movement of the pins 72, 74), which moves the stay pin 74 out of the leg portion 68 and into the hook portion 70 of the "J", permitting the cover 34 to pivot downwardly to close.

Those skilled in the art will recognize that the track 64 can be configured in a variety of configurations to carryout the pivoting and the stay-open features of the cover 34 of the present enclosed hose reel 10. For example, the track can be configured having a pair of straight track portions angularly offset from one another to achieve this result. Likewise, the track can be formed having an enlarged open region in lieu of the return to achieve this result. It is to be understood that these configurations, as well as other configurations that are intended to achieve the pivoting and "stay-open" results are within the scope of the present invention.

Referring now to FIG. 1, the enclosure 14 can include a foot rest 78 depending from one of the panels 26–32. The foot rest 78 is used when taking-up the hose H onto the spool 12 to prevent shifting or inadvertently lifting the enclosure 14. The foot rest 78 can be provided in a variety of configurations, which configurations will be recognized by those skilled in the art.

Figure 9:
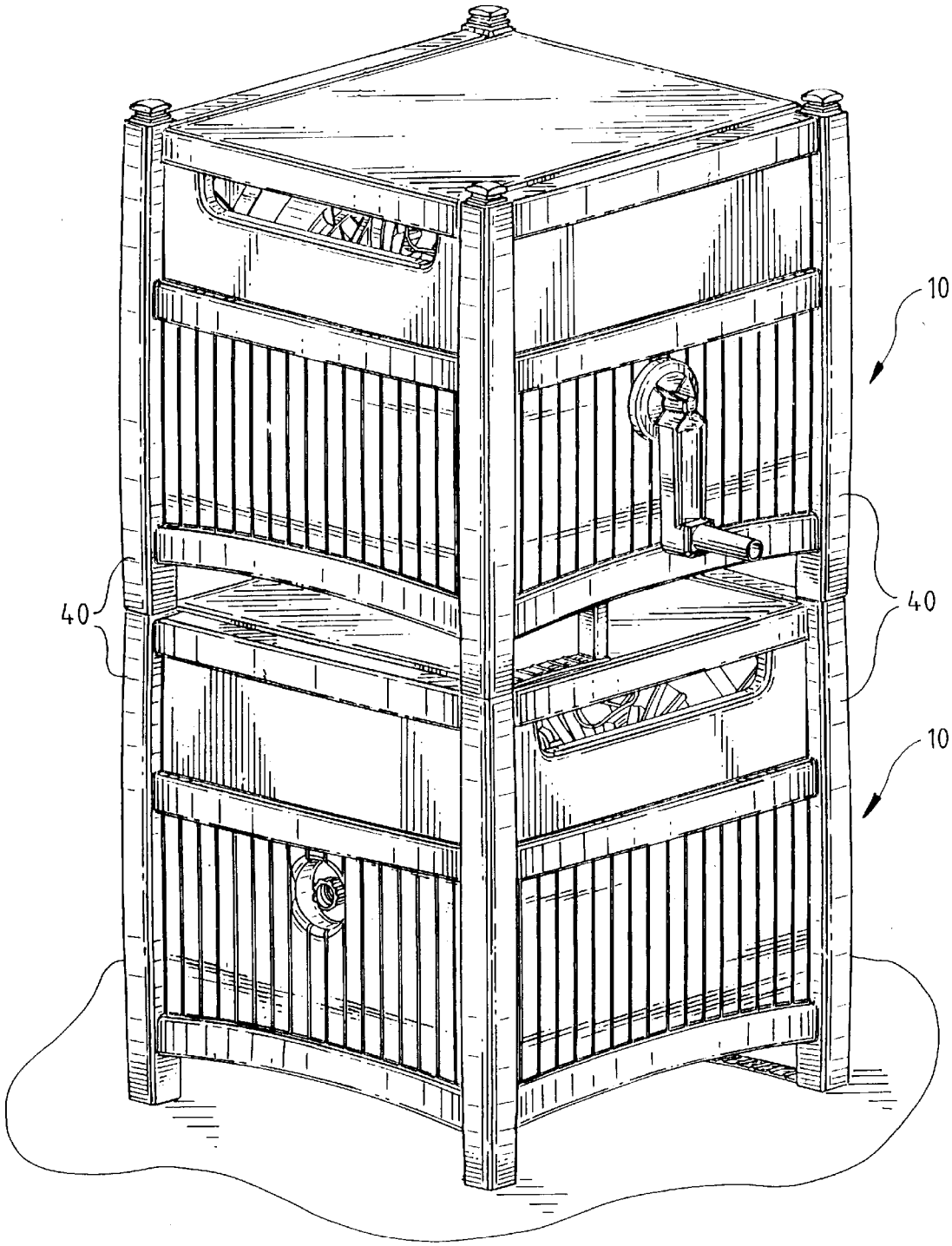
FIG. 9 is a perspective view of a pair of the hose reel storage devices as viewed from the perspective of FIG. 1, illustrated with the storage devices in a stacked arrangement.

The enclosure 14, and more particularly, the support posts 40 and caps or finials 46 can be configured so that the enclosures 14 can be stacked one on top of another. In one embodiment, a top pad 80 on each of the finials 46 is configured so that the pad 80 is received in the bottom of a support post 40 of an upper adjacent enclosure. Such a stacked configuration is illustrated in FIG. 9, and can be used, for example, during shipping of the enclosed hose reels 10. This stacked arrangement also provides many advantages for merchandising or displaying the hose reels 10, and can also be used when more than one hose reel 10 is stored, for example, for the winter months.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An enclosed hose reel for use with an associated flexible hose comprising:

a spool having a hub and a pair of flanges at opposing ends of the hub, the spool configured for storage, take-up and pay-out of the flexible hose;

an enclosure having front and rear wall panels, side wall panels extending between the front and rear wall panels, and a cover, the enclosure being configured for receiving the spool so as to rotate within the enclosure and for storing a length of flexible hose on the spool within the enclosure;

a pair of hinges for mounting the cover to the enclosure for movement between a closed position and an open position and for maintaining the cover in the open position, each hinge including a track formed in a respective side wall panel and a pair of pins associated and cooperative with each track, each track including a generally straight leg portion contiguous with a return portion that is non-linear with the straight leg portion, wherein when the cover is in the open position, both pins of each pair are positioned in the straight leg portion and when the cover is rotated into the closed position, one of each pair of pins traverses the straight leg portion so as to provide a sliding pivot and the other of each pair of pins traverses from the straight leg portion into the return portion so as enable closing the cover.

2. The enclosed hose reel in accordance with claim 1 wherein the non-linear portion of each track is arcuate.

3. The enclosed hose reel in accordance with claim 2 wherein the track has an upside-down "J" shape.

4. The enclosed hose reel in accordance with claim 3 wherein the track has a substantially constant cross-sectional width.

5. The enclosed hose reel in accordance with claim 1 wherein the cover includes a depending lip and wherein the pins extend from the lip.

6. The enclosed hose reel in accordance with claim 5 wherein the pins are formed as cylindrical elements extending from the lip, parallel to one another.

7. The enclosed hose reel in accordance with claim 1 wherein the front wall panel includes a cut-out portion at about a top edge thereof adjacent a junction with the cover when the cover is in the closed position, the cut-out configured for traversing a portion of the flexible hose therethrough to take-up and pay-out the hose with the cover in the closed position.

8. The enclosed hose reel in accordance with claim 1 wherein the spool extends essentially entirely between the side wall panels.

9. The enclosed hose reel in accordance with claim 1 wherein the enclosure includes a partition wall extending between the front and rear wall panels parallel to the side wall panels and wherein the spool extends between one of the side wall panels and the partition wall.

10. The enclosed hose reel in accordance with claim 9 including a support member extending between the partition wall and the side wall panel in opposing relation to the spool.

11. The enclosed hose reel in accordance with claim 10 wherein the support member defines a storage region.

12. The enclosed hose reel in accordance with claim 10 wherein the storage region is a shelf.

13. An enclosure for a hose reel for use with an associated flexible hose comprising:

a spool having a hub and a pair of flanges at opposing ends of the hub, the spool configured for storage, take-up and pay-out of the flexible hose;

an enclosure having front and rear wall panels, side wall panels extending between the front and rear wall panels, and a cover, the enclosure being configured for receiving the spool so as to rotate within the enclosure and for storing a length of flexible hose on the spool within the enclosure;

a pair of hinges for mounting the cover to the enclosure for movement between a closed position and an open position and for maintaining the cover in the open position, each hinge including a track formed in a respective side wall panel and a pair of pins associated and cooperative with each track, each track configured to permit collinear movement of both of the pins of each pair within the track for upward movement of the cover, and rotational movement of one of the pins of each pair relative to the other of the pins of each pair so as to rotate the cover about 90° relative to the upward movement into a closed position.

14. The enclosure in accordance with claim 13 including an opening therein configured for take-up and pay-out of the flexible hose when the cover is in the closed position.

15. The enclosure in accordance with claim 13 wherein the track and pins cooperate with one another to maintain the cover in the open position.

16. The enclosure in accordance with claim 13 wherein the enclosure is configured to receive the spool extending essentially entirely between the side wall panels.

17. The enclosure in accordance with claim 13 wherein the enclosure includes a partition wall extending between the front and rear wall panels parallel to the side wall panels and wherein the enclosure is configured to receive the spool extending between one of the side wall panels and the partition wall.

18. The enclosure in accordance with claim 17 including a support member extending between the partition wall and the side wall panel in opposing relation to the spool.

19. The enclosure in accordance with claim 18 wherein the support member defines a storage region.

20. The enclosure in accordance with claim 19 wherein the storage region is a shelf.

21. The enclosure in accordance with claim 13 wherein the track includes a substantially straight portion for providing collinear movement of the pins and an arcuate portion for providing rotational movement of one of the pins of each pair relative to the other of the pins of each pair.

22. The enclosure in accordance with claim 21 wherein the track has an upside-down "J" shape.

23. The enclosure in accordance with claim 22 wherein the track has a substantially constant cross-sectional width.

24. The enclosure in accordance with claim 13 wherein the front and rear panels each include a pair of parallel support posts extending along the ends thereof and integral with the panels, the support posts having elongated channels formed therein, and wherein the side panels include elongated fittings extending from ends thereof and integral therewith, the fittings being adapted to insert into the support post elongated channels for securing to the front and rear panels.

25. The enclosure in accordance with claim 24 wherein each of the support posts and the side panels each defines an opening in an upper portion thereof that align with one another when assembled, and wherein the enclosure includes end caps insertable into the respective openings to secure the side panels to the front and rear panels.

26. An enclosure comprising:

front and rear wall panels each include a pair of parallel support posts extending along ends thereof and formed integral therewith, the support posts having elongated channels formed therein;

side wall panels extending between the front and rear wall panels, the side panels including elongated fittings extending from ends thereof and integral therewith, the fittings being adapted to insert into the support post elongated channels for securing the side panels to the front and rear panels;

a cover for enclosing the front, rear and side panels when assembled; and a pair of hinges for mounting the cover to the enclosure for movement between a closed position and an open position and for maintaining the cover in the open position, each hinge including a track formed in a respective side wall panel and a pair of pins associated and cooperative with each track, each track configured to permit collinear movement of both of the pins of each pair within the track for upward movement of the cover, and rotational movement of one of the pins of each pair relative to the other of the pins of each pair so as to rotate the cover about 90° relative to the upward movement into a closed position.

27. The enclosure in accordance with claim 26 wherein the track and pins cooperate with one another to maintain the cover in the open position.

28. The enclosure in accordance with claim 26 wherein the enclosure includes a partition wall extending between the front and rear wall panels parallel to the side wall panels, wherein the front and rear panels include partition wall channels and wherein the partition wall includes elongated fittings extending from ends thereof and integral therewith, the partition wall fittings being adapted to insert into the front and rear wall partition wall channels for securing the partition wall to the front and rear panels.

29. The enclosure in accordance with claim 27 including a support member extending between the partition wall and one of the side wall panels.

30. The enclosure in accordance with claim 27 wherein the track includes a substantially straight portion for providing collinear movement of the pins and an arcuate portion for providing rotational movement of one of the pins of each pair relative to the other of the pins of each pair.

31. The enclosure in accordance with claim 30 wherein the track has an upside-down "J" shape.

32. The enclosure in accordance with claim 31 wherein the track has a substantially constant cross-sectional width.

* * * * *